United States Patent [19]

Phillips et al.

[11] Patent Number: 4,502,685

[45] Date of Patent: Mar. 5, 1985

[54] TENNIS SERVE PRACTICE DEVICE

[76] Inventors: Vanice C. Phillips, 2401 Shady Grove, Bedford, Tex. 76021; Glendale Phillips, R.R. 2, Box 708, Scurry, Tex. 75158

[21] Appl. No.: 304,117

[22] Filed: Sep. 21, 1981

[51] Int. Cl.[3] ..... A63B 61/00

[52] U.S. Cl. ..... 273/29 A

[58] Field of Search ..... 273/29 A, 331, 332, 273/333, 348, 390, 402, 369, 55 R; 248/163 A, 166; 272/63, 61, 109; 46/130, 133, 147

[56] References Cited

U.S. PATENT DOCUMENTS

| | | | |
|---|---|---|---|
| 1,523,989 | 1/1925 | Wright | 46/130 |
| 2,169,710 | 8/1939 | Schmidt | 272/109 |
| 2,305,187 | 12/1942 | Neider | 273/29 A |
| 2,749,659 | 6/1956 | Elstein | 273/333 |
| 2,944,815 | 7/1960 | Moyer | 272/109 |
| 3,615,092 | 2/1970 | Stubbmann | 272/61 |
| 4,023,798 | 5/1977 | Pronin . | |
| 4,049,266 | 9/1977 | Feiler | 273/29 A |
| 4,114,873 | 9/1978 | Jones | 272/61 |
| 4,141,550 | 2/1979 | Denizman . | |

FOREIGN PATENT DOCUMENTS

| | | | |
|---|---|---|---|
| 425851 | 10/1947 | Italy | 273/29 A |
| 240652 | 6/1925 | United Kingdom | 273/29 A |
| 489842 | 8/1938 | United Kingdom | 273/29 A |

*Primary Examiner*—Richard C. Pinkham
*Assistant Examiner*—T. Brown
*Attorney, Agent, or Firm*—Richards, Harris, Medlock & Andrews

[57] ABSTRACT

A tennis service practice device (20) includes an upright frame (24) having an overhead bar (30) supported horizontally from the upright frame. A rigid target device (32) is supported from the overhead bar to permit free swinging movement and free sliding longitudinal movement of the target device on the bar. In one embodiment, the target device includes a circular hoop (90) having a pair of arms (92, 94) extending from the hoop and having curved ends (96, 98) for encircling engagement around the horizontal bar (30).

13 Claims, 7 Drawing Figures

TENNIS SERVE PRACTICE DEVICE

TECHNICAL FIELD

The present invention relates to a device for practicing a tennis serve and more specifically such a device which is easily positionable to accommodate all users.

BACKGROUND ART

The serve is one of the most important aspects of the game of tennis. While a good serve requires proper body positioning and movement, proper toss of the ball is also critical to an effective serve. A serve must be consistent and thus consistency in each of the elements necessary to a proper serve is critical. A player must be able to repeat with consistency proper body positioning and movement, grip of the tennis racket, as well as the toss of the ball.

The toss of the ball must be to a proper height as well as to a proper position relative to the server. While the height and position of the ball toss will vary from server to server, it is critical that the player be able to properly position the ball overhead by the toss for an effective serve.

Devices have been developed to provide an overhead reference to assist in making the ball toss for the serve. Examples of these devices are disclosed in U.S. Pat. No. 4,023,798, issued May 17, 1977 to Alexander Pronin and U.S. Pat. No. 4,141,550, issued Feb. 27, 1979 to N. H. Denizman. While these devices provide some assistance in executing the serve, the devices are extremely complex in their construction and overly complicated in their usage. For example, the device illustrated in the patent to Pronin includes a complex and bulky overhead target for use in conjunction with a ground target which is aligned therebelow. In the patent to Denizman, the overhead target incorporates a signalling device and net structure and is used only in simulating the serve. Thus, a need exists for a device which is both simple in construction and design that assists a player in actually practicing the tennis serve.

DISCLOSURE OF THE INVENTION

The present invention provides a tennis serve practice device which is both simple in design and construction, yet capable of being fully adjusted to accommodate players of varying heights, as well as both left-handed and right-handed servers. The tennis serve practice device includes an upright frame having an overhead bar supported horizontally from the upright frame. A rigid target device is supported from the overhead bar by engagement means which permits free swinging movement and free sliding longitudinal movement of the target device on the bar. In a preferred embodiment of the invention, the target device includes a circular hoop having a pair of arms extending substantially perpendicularly therefrom. The arms are curved at their ends opposite their connection to the hoop for encircling engagement around the horizontal bar. This engagement permits the target device to swing relative to the bar and to freely slide longitudinally on the bar.

The curved ends of the arms extend substantially around the overhead bar to prevent disengagement of the target from the bar. The target device is both rigid in its construction and is sufficiently light to permit longitudinal sliding of the target on the bar by engagement of any part of the device. Thus, the longitudinal position of the device on the overhead bar may be adjusted by the user by merely engaging the target device using, for example, a tennis racket.

The upright frame includes a pair of substantially parallel vertical legs supported from a base. In the preferred embodiment, the base defines an enclosed perimeter in which the server stands. The overhead bar is supported from the ends of the legs remote from the base. The bar is positioned such that its vertical projection onto the ground surface lies within the perimeter of the base. One or more positioning straps may be attached from spaced points on the perimeter of the base as desired to assist the user in positioning himself relative to the target device. The vertical legs of the upright frame are designed to telescope, thereby permitting the adjustment of the height of the overhead bar relative to the ground surface. In this way, the height of the target device may be adjusted as desired by the user. By sliding the target device along the longitudinal length of the overhead bar, it may be positioned relative to the base as desired. This also permits positioning of the target device for both left-handed and right-handed servers.

BRIEF DESCRIPTION OF DRAWINGS

For a more complete understanding of the present invention, and further details and advantages thereof, reference is now made to the following description taken in conjunction with the accompanying drawings, in which.

DETAILED DESCRIPTION

Figure 1:
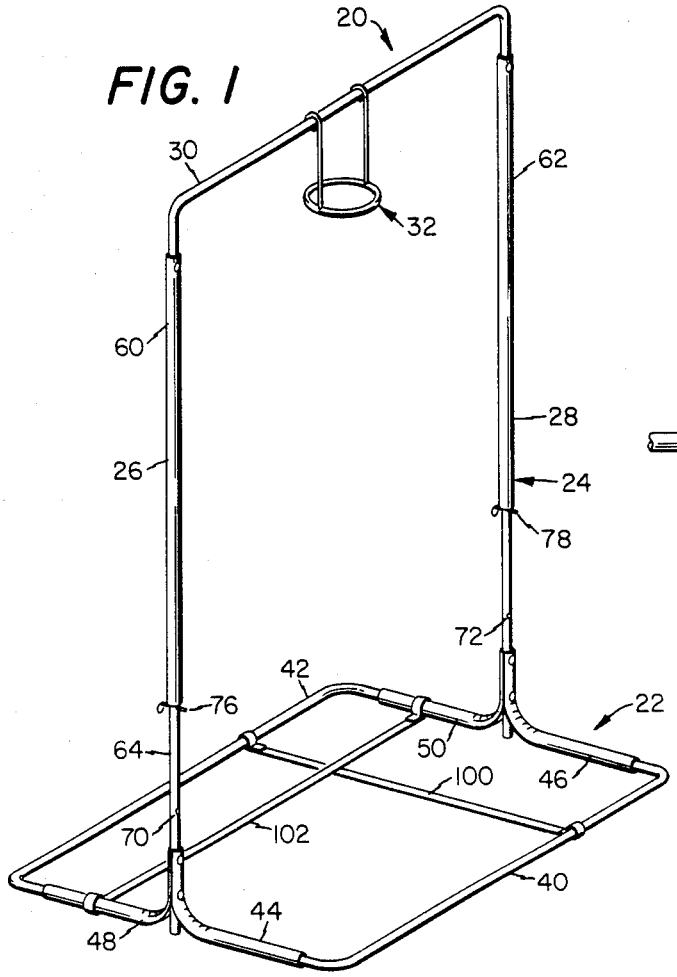
FIG. 1 is a perspective view of the tennis serve practice device according to the present invention.

Referring to the drawings, and particularly FIG. 1 thereof, the numeral 20 designates a preferred embodiment of the tennis serve practice device according to the present invention. The practice device 20 has a base 22 with an upright frame 24 extending therefrom. Frame 24 includes a pair of substantially parallel vertical legs 26 and 28 with an overhead bar 30 connected therebetween. A target device 32 is attached to overhead bar 30 as will be described hereinafter in greater detail.

Base 22 includes two identical halves each including an identical U-shaped member 40 and 42, respectively. The ends of tubular member 40 are received within one end of L-shaped members 44 and 46, respectively. Similarly, the ends of U-shaped tubular member 42 are received within one end of L-shaped members 48 and 50, respectively. The ends of L-shaped members 44, 46, 48 and 50 remote from U-shaped members 40 and 42 are flattened and radiused for attachment to the lower end of legs 26 and 28 by bolts or other similar attachment structure.

As can be seen in FIG. 1, base 22 provides a substantially rectangular perimeter. In the preferred embodiment, the length of the perimeter defined by members 40 and 42 is on the order of seven feet, while the dimension of the perimeter defined by members 44, 46, 48 and 50 in conjunction with members 40 and 42 is on the order of six and one half feet. It will be understood that these dimensions may be varied, either larger or smaller as is desired, to accomplish the intent of the present invention.

Legs 26 and 28 each include an outer upper sleeve 60 and 62, respectively, which telescope over a lower leg section 64 and 66, respectively. Sections 64 and 66 are the portions of legs 26 and 28 which are attached to base 22. Lower leg sections 64 and 66 have a plurality of spaced apertures 70 and 72 which receive pins 76 and 78 therein to permit adjustment of the height of upper sleeves 60 and 62. Overhead bar 30 is of a U-shaped design with its ends dimensioned for engagement within the upper end of sleeves 60 and 62 of legs 26 and 28, respectively. Overhead bar 30 is attached to sleeves 60 and 62 by appropriate fittings or other attachment means as desired.

Figure 2:
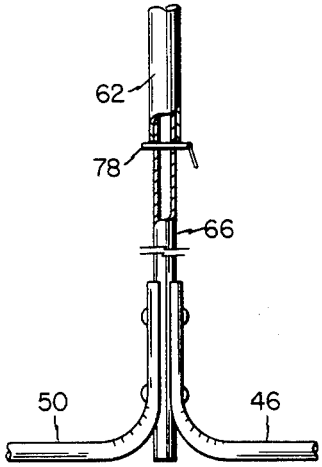
FIG. 2 is a side plan view of a portion of the frame and base used in the present invention.

The attachment of L-shaped members 46 and 50 to lower leg section 66 is shown in FIG. 2. Similarly, engagement of pins 78 into one of the apertures 72 is also seen in FIG. 2.

Figure 3:
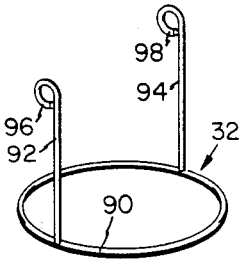
FIG. 3 is an enlarged perspective view of the target device.
Figure 4:
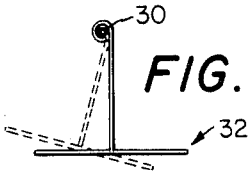
FIG. 4 is a side view of the target device illustrating the possible swinging movement of the target device.

Referring to FIGS. 1 and 3, target 32 includes a circular hoop 90 having a pair of arms 92 and 94 extending substantially perpendicularly from the plane of the hoop. Arms 92 and 94 are attached to hoop 90 substantially at opposite points on the diameter of the hoop. The ends 96 and 98 of arms 92 and 94 remote from hoop 90 are curved for engagement around overhead bar 30. As can be seen in FIG. 4, in the preferred embodiment, ends 96 and 98 are curved sufficiently to leave a gap between the ends of arms 92 and 94 and the arms themselves of less than the diameter of bar 30, thereby preventing the target from becoming disengaged from bar 30. Target 32 is initially installed on overhead bar 30 by threading bar 30 through curved ends 96 and 98 prior to assembly of the bar onto legs 26 and 28.

Referring again to FIG. 1, a positioning strap 100 is attached between bars 40 and 42 and a positioning strap 102 is attached between L-shaped bars 48 and 50. Attachment may be by any appropriate means such as use of an appropriate adhesive. Alternatively, the ends of each strap may be fitted with Velcro such that the strap may be looped around the bars and engaged to itself, thereby fixing the straps on the bars. In this way, the straps may be easily removed or slid relative to the bars to properly position the straps as desired by the user. Straps 100 and 102 are merely positioning guides which are set by the server so that the server's position relative to target 32 may be fixed.

Figure 5:
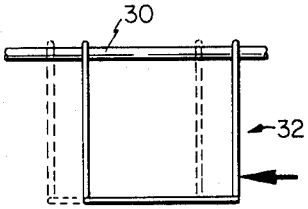
FIG. 5 is a front plan view of the target device of the present invention showing the possible longitudinal movement of the target device relative to the frame.

In use of the apparatus, straps 100 and 102 are positioned as desired by the user. The height of target 32 is adjusted upwardly or downwardly by telescoping legs 26 and 28. This is accomplished by moving the upper sleeves 60 and 62 relative to the lower leg sections 64 and 66 and inserting pins 76 and 78 into the appropriate apertures in the lower leg sections. With the target height adjusted properly, the position of target 32 along overhead bar 30 is easily set as is illustrated in FIG. 5 by touching any portion of the target and applying a sufficient force to slide the target on bar 30. With the target in the desired position along the longitudinal length of bar 30, the server then practices his serve by making a serving toss toward the target as defined by hoop 90 and engaging the ball at the height of its travel or as it begins its descent.

It will be appreciated that target 32 is adjusted to a height above the uppermost stretch of the server's swing. In this way, the target is not contacted by the server's racket and does not interfere with the practice serve. However, in the event that the user extends his reach to engage target 32, the target easily swings on bar 30, thereby preventing any serious damage to the racket or the server. The swinging action permitted by the design of the present invention is illustrated in FIG. 4 wherein the target is shown in side lines in its at rest position and dotted lines in the position which it might assume if struck by the racket. It will be appreciated that curved ends 96 and 98 of target 32 sufficiently encircle bar 30 to prevent the target from becoming disengaged from bar 30.

Figure 6:
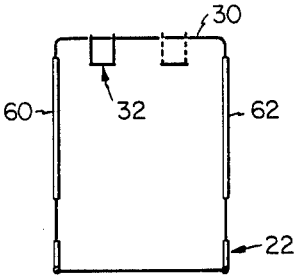
FIG. 6 is a schematic representation showing the movement of the target device relative to the frame.
Figure 7:
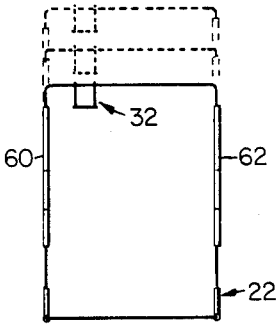
FIG. 7 is a schematic view showing the vertical adjustment of the frame.

It will now be appreciated that the present invention provides a target which may be easily adjusted both in height and in position along a horizontal overhead bar supported from vertical side legs. Thus, the present invention provides a target device which may be easily used by both a left and right-hand server. The relative positions for the target for a left and right-hand server are illustrated in FIG. 6. Further, the user may position target 32 at an unlimited number of positions along bar 30. Because of the rigid design of target 32 and the fact that the target is attached to bar 30 by the curved ends 96 and 98 of arms 92 and 94 at spaced points of contact, the target slides freely along bar 30 by engagement of the target from below at any point thereon. Thus, the user may merely reach the target using his tennis racket and readily slide the target to any desired position. In this way, proper position for the target may be obtained easily and may be adjusted relative to the user's feet position as defined by straps 100 and 102 to perfect his serve.

The simple design of the target device makes it very lightweight to facilitate its movement on the overhead bar. Because curved ends 96 and 98 are made from a small diameter rod having a circular cross section and in view of the lightweight construction of the target device, very little friction exists between the two points of contact at curved ends 96 and 98 and bar 30, thereby facilitating movement of the target relative to bar 30 as required.

The present invention defines a very straightforward tennis serve practice device which may be made from a minimum of components. Although the design is quite simple in construction, it is also extremely sturdy, as well as being very stable. Thus, an inadvertent engagement of target 32 does not result in any movement of the practice device and certainly the device could not be tipped over in view of the design of the upstanding vertical legs and base to which they are attached.

Although preferred embodiments of the invention have been described in the foregoing detailed description and illustrated in the accompanying drawings, it will be understood that the invention is not limited to the embodiments disclosed, but is capable of numerous rearrangements, modifications and substitutions of parts and elements without departing from the spirit of the invention. Accordingly, the present invention is intended to encompass such rearrangements, modifications and substitutions of parts and elements as fall within the spirit and scope of the invention.

We claim:

1. A tennis serve practice device comprising:

an overhead bar supported a predetermined distance from a ground surface; and a rigid target device, supported from said overhead bar, including a circular hoop having a pair of legs extending sustantially perpendicularly from the plane of the hoop and having curved ends opposite said hoop for engagement around said overhead bar, said curved ends extending substantially around said overhead bar to prevent disengagement of said target device from said bar while permitting free swinging movement and free sliding longitudinal movement of said target device on said bar.

2. The practice device according to claim 1 wherein said target device is sufficiently light to permit longitudinal sliding of said device on said bar by engagement of any part of the device.

3. The practice device according to claim 1 further comprising an upright frame for supporting said overhead bar substantially horizontally therefrom.

4. The practice device according to claim 3 wherein said upright frame is adjustable in height to permit positioning said overhead bar at a predetermined height from the ground surface.

5. The practice device according to claim 4 wherein said upright frame includes a pair of substantially parallel vertical legs supported from a base defining an enclosed perimeter with the overhead bar supported from the ends of said legs remote from said base, said overhead bar being positioned such that its vertical projection onto the ground surface lies within the perimeter of the base.

6. An aid for practicing a tennis serve comprising:

an upright frame;

an overhead bar supported substantially horizontally from said upright frame and positioned to permit a user to assume a position thereunder; and a target device supported from said overhead bar, said target device to be used by the user to direct a tennis ball theretoward and comprising arms having a common circular target attached at one end thereof, said target having its plane substantially perpendicular to said arms and bar engagement means on the opposite end thereof, said engagement means permitting free swinging movement and free sliding longitudinal movement of said target device on said bar.

7. The aid according to claim 6 wherein said target device is sufficiently rigid to permit sliding longitudinal movement of said device on said bar by engagement of any portion of said target device.

8. The aid according to claim 6 wherein the engagement means of said target device has two spaced points of contact with said overhead bar, thereby permitting free sliding longitudinal movement of said target device on said bar.

9. The practice device according to claim 6 wherein said target device is sufficiently light to permit longitudinal sliding of said device on said bar by engagement of any part of the device.

10. The practice device according to claim 6 wherein said upright frame includes a pair of substantially parallel vertical legs supported from a base defining an enclosed perimeter with the overhead bar supported from the ends of said legs remote from said base, said overhead bar being positioned such that its vertical projection onto the ground surface lies within the perimeter of the base.

11. An aid for practicing a tennis serve comprising:

an upright frame;

an overhead bar supported substantially horizontally from said upright frame; and a target device supported from said overhead bar by engagement means permitting free swinging movement and free sliding longitudinal movement of said target device on said bar, said target device comprising a circular hoop having a pair of legs extending substantially perpendicularly from the plane of the hoop and having curved ends opposite said hoop for engagement around said overhead bar, said curved ends extending substantially around said overhead bar to prevent disengagement of said target device from said bar.

12. A tennis serve practice device comprising:

an overhead bar supported a predetermined distance from a ground surface and a rigid target device supported from said overhead bar by engaging means permitting free swinging movement and free sliding longitudinal movement of said target device on said bar;

an upright frame for supporting said overhead bar substantially horizontally therefrom, said upright frame being adjustable in height to permit positioning of said overhead bar at a predetermined height from the ground, and comprising a pair of substantially parallel vertical legs supported from a base defining an enclosed perimeter with the overhead bar supported from the ends of said legs remote from said base, said overhead bar being positioned such that its vertical projection onto the ground surface lies within the perimeter of the base; and freely movable positioning straps extending from a first point on the perimeter of said base to a second point, spaced from said first point, on the perimeter of said base for use by the user in assuming a desired position relative to the target device.

13. An aid for practicing a tennis serve comprising:

an upright frame;

an overhead bar supported substantially horizontally from said upright frame; and a target device supported from said overhead bar by engagement means permitting free swinging movement and free sliding longitudinal movement of said target device on said bar;

said upright frame comprising a pair of substantially parallel vertical legs supported from a base defining an enclosed perimeter with the overhead bar supported from the ends of said legs remote from said base, said overhead bar being positioned such that its vertical projection onto the ground surface lies within the perimeter of the base;

a freely movable positioning strap extending from a first point on the perimeter of said base to a second point, spaced from the first point, on the perimeter of said base for use by the user in assuming a desired position relative to the target device.

* * * * *